United States Patent [19]

Faller

[11] 4,260,060

[45] Apr. 7, 1981

[54] FOOD CARTON FOR MICROWAVE HEATING

[75] Inventor: Rudolph A. Faller, Edina, Minn.

[73] Assignee: Champion International Corporation, Stamford, Conn.

[21] Appl. No.: 76,216

[22] Filed: Sep. 17, 1979

[51] Int. Cl.[3] ..... B65D 5/70

[52] U.S. Cl. ..... 206/622; 426/113; 229/17 B

[58] Field of Search ..... 229/22, 17 B, 42, 3.5 MF; 426/113, 115; 40/124.1, 539

[56] References Cited

U.S. PATENT DOCUMENTS

| | | | |
|---|---|---|---|
| 2,135,124 | 11/1938 | Englar | 40/539 |
| 2,565,146 | 8/1951 | Okom | 229/42 |
| 2,777,769 | 1/1957 | Hodges | 426/113 |
| 3,272,328 | 9/1966 | Knzyzanowski | 229/42 X |
| 3,432,087 | 3/1969 | Costello | 426/113 X |
| 3,453,661 | 7/1969 | Repko | 426/115 |
| 3,672,916 | 6/1972 | Virnig | 426/113 X |
| 3,876,131 | 4/1975 | Tolaas | 229/22 |
| 4,030,596 | 6/1977 | Snyder et al. | 229/17 B |
| 4,096,948 | 6/1978 | Kuchenbecker | 206/622 |

*Primary Examiner*—Davis T. Moorhead
*Attorney, Agent, or Firm*—Evelyn M. Sommer

[57] ABSTRACT

Disclosed is a carton which is especially adapted for heating food products such as pizza, in microwave ovens. The bottom surface of the carton is cut to provide a plurality of tabs, which when bent from the carton, provide legs which space the bottom of the carton from a shelf in the oven, thereby allowing moisture vapor generated during heating to escape. According to a preferred embodiment, a moisture barrier film is releasably adhered to the bottom surface of the carton and a plurality of tabs so that, upon removal of the film prior to heating, the tabs are bent into their operable support position and the vent holes are opened.

10 Claims, 8 Drawing Figures

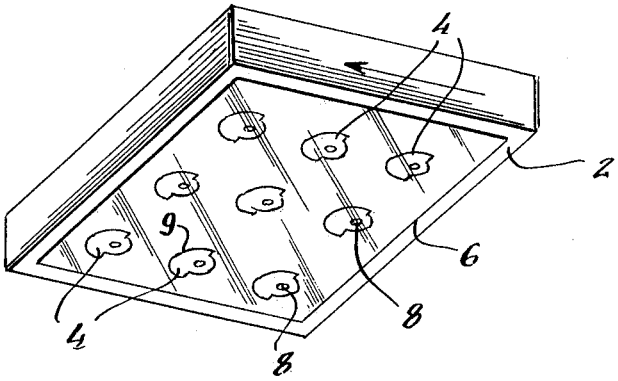
Fig. 1.
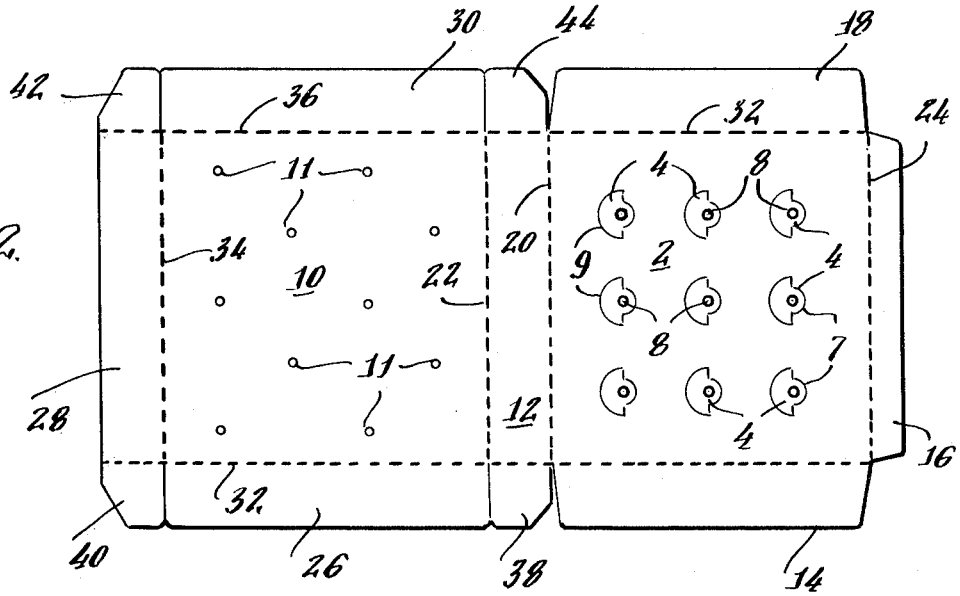
Fig. 2.
Fig. 3.
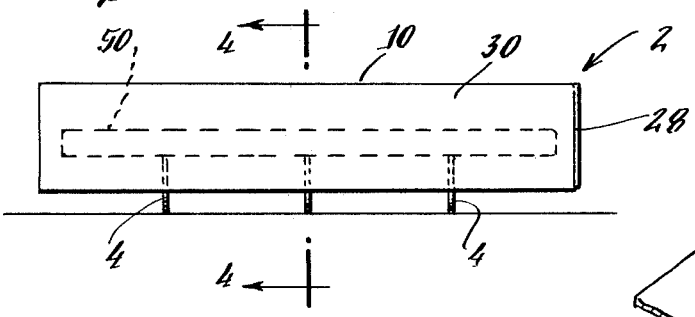
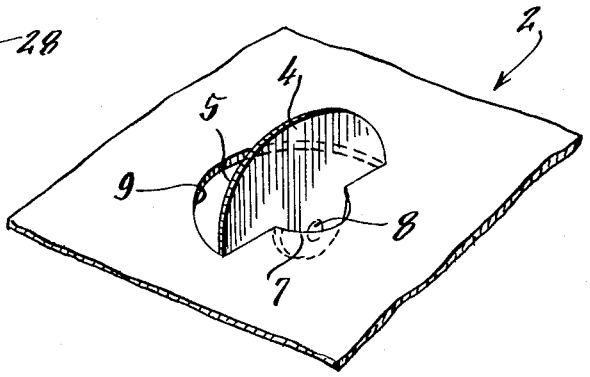
Fig. 5.
Fig. 4.
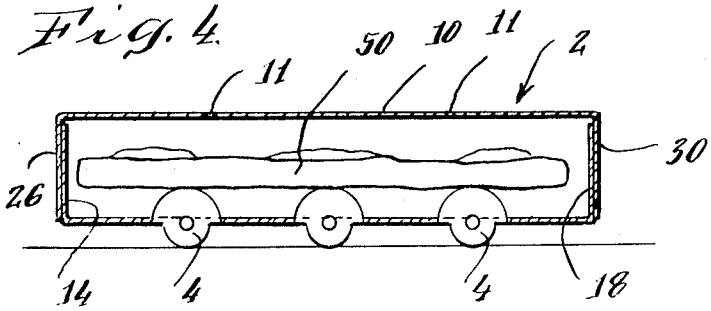

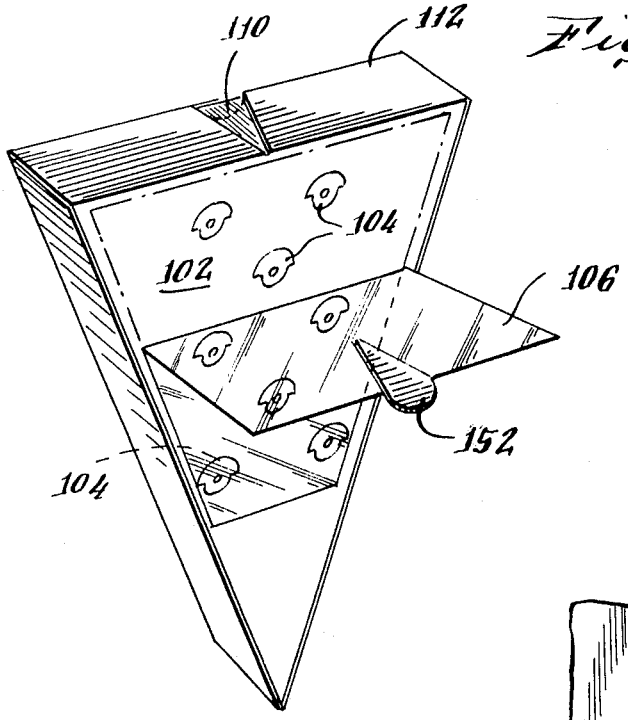
Fig. 6.
Fig. 7.
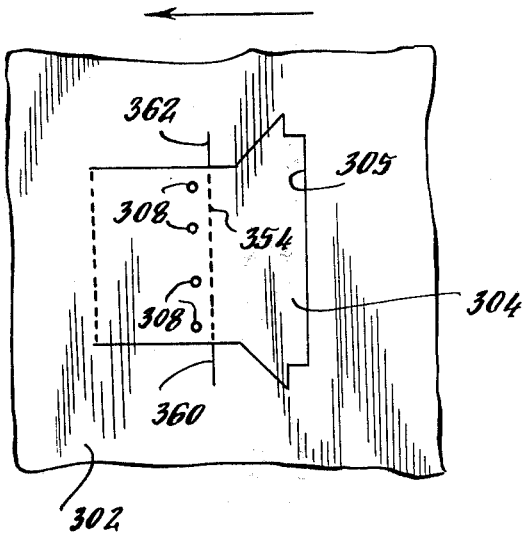
Fig. 8.
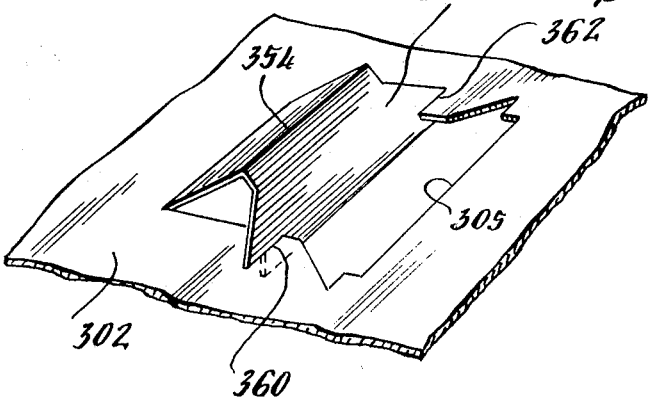

FOOD CARTON FOR MICROWAVE HEATING

BACKGROUND OF THE INVENTION

This invention relates to an improved carton for heating food products in a microwave oven, and more specifically to a carton of this type with integral support means and apertures for permitting the release of moisture during heating.

In U.S. Pat. No. 3,876,131 and U.S. Pat. No. Re29,185, it was recognized that packages useful for heating foods by microwave ovens must be vented to permit exhaustion of moisture vapors generated during the heating process, but yet must be sealed for protection of the food during shipment and storage. To meet these criteria, these patents disclosed placing apertures in the bottom of the carton and covering these with a strip of film which could be removed prior to heating.

It was also found important to elevate the bottom surface of the carton from the microwave oven shelf so that the moist gases could be more efficiently exhausted from the container. This requirement was met by provision of side wall panels which extended downwardly below the plane of the bottom surface of the container. In effect, the side walls formed legs which raised the container above the support surfaces.

While the provision of downwardly extending side walls does provide for efficient exhaustion of gases from the container, these protrusions from the plane of the bottom surface require the employment of extra material in manufacturing and cause additional limitations on the configurations in which the packages can be placed in shipping cases.

SUMMARY OF THE INVENTION

It is an object of the present invention to provide a carton especially adapted for heating food products, such as pizza, in an oven and particularly a microwave oven, which does not require the use of an enlarged blank for making legs which extend below the bottom surface of the carton.

It is another object of the present invention to provide a carton especially adapted for heating food products in a microwave oven, which has a substantially planar bottom surface with no downwardly extending portions which would restrict freedom in stacking the cartons in a shipping case.

It is yet another and more specific object of the present invention to provide a carton especially adapted for heating food products in a microwave oven, which has a substantially planar bottom surface when the food is packaged therein but which, when ready for heating, is simply provided with means for supporting the carton and spacing its bottom from the microwave oven shelf to provide efficient exhaustion of gases from the container.

It is still another and more specific object of the present invention to provide a carton especially adapted for heating a food product in a microwave oven, which has a substantially planar bottom surface covered with a moisture barrier film to protect the product packaged therein during storage and handling, wherein apertures are opened and means for supporting the container are formed by simply pulling off the moisture barrier film.

These and other objects are accomplished according to the present invention which provides a carton including: a substantially planar bottom panel; first side walls hinged to the edges of said bottom panel and extending upwardly therefrom; a top panel hingedly secured along one edge of one of said side walls and extending substantially parallel to said bottom panel, said top panel being substantially identical in size and shape to said bottom panel; second side walls hingedly secured to the remaining edges of said top panel and extending downwardly therefrom, and secured to said first side walls; said bottom panel being cut to define a plurality of tabs, displacement of which from the plane of the bottom panel provides vent openings in the bottom panel and provides means for supporting the carton.

BRIEF DESCRIPTION OF THE DRAWINGS

The invention will become better understood from the following detailed description, especially when read in in light of the attached drawings wherein:

FIG. 1 is a perspective view of a preferred embodiment allowing viewing of the underside of the container;

FIG. 2 is a diagrammatic view of a carton blank from which a carton as shown in FIG. 1 can be formed;

FIG. 3 is a side elevational view of a carton as shown in FIG. 1;

FIG. 4 is a cross-section taken along line 4—4 in FIG. 3, showing support tabs protruding above and below the bottom panel;

FIG. 5 is a perspective view from the carton interior showing an open tab of the type shown in FIGS. 1–4;

FIG. 6 is a perspective view of a triangular shaped carton with a quick opening pull tab feature;

FIG. 7 is a bottom plan view showing an alternative support tab form; and

FIG. 8 is a perspective view showing the tab of FIG. 7 in open position.

DETAILED DESCRIPTION OF THE INVENTION

A preferred form of the carton of this invention is shown in various view in FIGS. 1–5. In FIG. 1, a carton is shown in perspective, allowing the bottom to be viewed. The substantially planar bottom panel 2 is cut to provide a plurality of tabs 4. Also shown in FIG. 1 is a strip of a moisture barrier film 6 releasably secured to the bottom panel to seal the openings made at the cut lines. The film is secured by applying a glue line to the periphery of the strip of film 6 and at selected points 8 on the tabs 4. When the strip of film is torn from the carton in the direction of the arrow shown in FIG. 1, the tabs 4 will be displaced downwardly from the plane of the bottom panel and form means for supporting the carton in spaced relation from the surface it is to rest on. Also in this embodiment, the tabs will be displaced upwardly from the plane of the bottom panel 2 so that a food product contained within the carton will be supported above the bottom panel 2, as shown in FIG. 4. The detail of one such tab is shown in FIG. 5. As can be seen, each of the tabs is formed by two semi-circular cut lines 7 and 9 made on opposite sides of a common fold line. The radii of the semicircles are unequal to permit one portion of the tab 4 to be bent upwardly and the opposite end to be bent downwardly. The detail of other alternative tabs is seen in FIGS. 7 and 8. According to the preferred embodiment, the tabs are bent more than 90° and will be held in open position due to the resilience and memory of the carton material, typically paperboard, being balanced by the weight of the product resting on top of the tabs. Also, conventional friction or locking means (not shown) formed integral with bottom panel 2 may be provided to assure that the tabs are held in their open position.

The displacement of tabs 4 from the plane of the bottom panel provides vent openings 5 (seen best in FIG. 5) which permit the escape of moisture generated during heating. Thus, according to this preferred embodiment of the present invention, a piece of pizza or a sandwich can be stored frozen, protected by the outer packaging material, and then by simply pulling off the film 6, be prepared for heating in the carton in a microwave oven, with vent holes 5 properly opened and support tabs 4 properly positioned to permit efficient venting of moisture developed during heating. In some cases, it may be desirable to provide apertures 11, in the top panel 10 to allow steam within the carton to escape through the top panel when such carton is heating during use.

The radius defined by the cut lines 7 and 9 will determine the distance that the food product 50 is elevated above the bottom panel 2; in some cases only minimal spacing between the product 50 and the bottom panel 2 will be required to achieve the desired results so that the side wall panels 26, 28 and 30 will be of minimum height in order to reduce the material needed to fabricate the carton.

Referring to FIG. 2, a blank is shown which, when folded, results in the carton as shown in FIG. 1. This blank has a bottom panel 2 having cut lines defining tabs 4 as previously described. The bottom panel is appended by first side walls 12, 14, 16 and 18 hinged to the edges of the bottom panel 2 and extending upwardly therefrom in the formed carton. The top panel 10 is joined to the bottom panel 2 by side wall panel 12 of generally rectangular shape. Apertures 11 in top panel 10 may be formed by die cutting. The side wall panel 12 is hinged to the bottom panel 2 by fold line 20 and to the top panel 10 by fold line 22. In the assembled carton side wall 16 forms the side wall opposite panel 12. Side wall panel 16 is joined to bottom panel 2 at fold line 24.

Second side wall panels 26, 28 and 30 are hinged to the edges of the top panel 10 about hinge lines 32, 34 and 36 respectively. Corner flaps 38, 40, 42 and 44 are also provided.

To assemble the carton, the blank is folded about fold lines 20, 22, 24 and 34 to join side wall panel 16 to side wall panel 28. Panel 16 is then secured to panel 28 by suitable means such as glue. Next, the product 50 is placed inside the container, the corner flaps 38, 40, 42 and 44 are folded in, side wall panels 14 and 18 are folded upwardly, and the side wall panels 26 and 30 are folded downwardly and secured to side wall panels 14 and 18.

A feature of the present invention is that a moisture barrier film is not required for all products and all methods of distribution because the vent holes are not opened until it is time to heat the product. When required, however, or simply when desired due to the ease of opening the tabs which it permits, it is preferably glued on while the blank is flat, prior to folding. The adhesive should form a suitable bond and be strong enough to hold the tabs until pulled open, preferably more than 90° from the plane of the bottom panel 2. However, the adhesive should not be so strong as to cause damage to the carbon or ripping of the films upon opening. Preferably, the adhesive will be of the polyvinylacetate/polyvinylchloride copolymer type, with National 33-1413 being one example of a suitable commercial material. The film can be any of the conventional materials available having the proper combination of strength and gas barrier properties for the particular packaging need. The film can be plastic, metal or laminate. One film which has been proved successful for frozen pizza is 48 gauge mular-Du Pont Polyester.

FIG. 6 shows another embodiment of the present invention. This triangular shaped package may be employed in connection with products normally sold or consumed in this shape. Shown in FIG. 6 is a pull tab 152 which is tightly secured to film 106 to permit removal of the entire film 106 by pulling tab 152. The tab 152 is formed by making spaced cuts in a suitable pattern in the top panel 110 and the side wall panel 112. Inserting a thumb through the cut line in top panel 110 and pulling down, separates tab 152 from the top panel 110 and the wall panel 112 and starts stripping the film 106 from the carton bottom 102. As with the embodiment of FIG. 1, pulling the film 106 displaces tabs 104 from the plane of the bottom panel 102 and opens vent holes where they are displaced. The pull tab 152 may extend into the top panel of the carton and could form a venting aperture (not shown) when removed to allow escape of steam from the carton during heating thereof.

In FIG. 7, there is shown another embodiment of a tab according to this invention. Tab 304 has a creased fold line 354 and areas of adhesive 308 to which a film (not shown) is adhered. The bottom panel 302 is cut not only to define tab 304, but also to form slit cuts 360 and 362 in an area generally adjacent the location of fold line 354 while in the flat position. By pulling a film (not shown) in the direction of the arrow shown in FIG. 7, the tabs will be bent as shown in FIG. 8, thereby forming means for supporting the carton and opening vent holes 305. Stepped tab end 364 is then inserted within the slits 360 and 362 to lock the tab 304 in place.

The above description is for the purpose of explaining the present invention to those skilled in the art, but is not meant to include all those obvious modifications and variations thereof which will become apparent upon reading. It is intended, however, that all of such modifications and variations be included within the present invention, the scope of which is defined by the following claims.

What is claimed is:

1. A carton including:

a substantially planar bottom panel;

first side walls hinged to the edges of said bottom panel and extending upwardly therefrom;

a top panel hingedly secured along one edge to one of said side walls and extending substantially parallel to said bottom panel, said top panel being substantially identical in size and shape to said bottom panel;

second side walls hingedly secured to the remaining edges of said top panel and extending downwardly therefrom and secured to said first side walls;

said bottom panel being cut to define a plurality of integral tabs, downward displacement of which from the plane of said bottom panel, simultaneously providing vent openings in the bottom panel and means for supporting the carton off of said bottom panel for open communication of said vent openings in one operation without the necessity of a further manipulation of said plurality of integral tabs.

2. A carton according to claim 1 wherein the top and bottom panels are generally rectangular in shape.

3. A carton according to claim 1 wherein the top and bottom panels are generally triangular in shape.

4. A carton according to claim 1 which further includes a strip of film secured to the under surface of the bottom panel, the film being releasably secured such that as it is pulled for removal, the tabs are displaced from the plane of the bottom panel and the vent openings are opened.

5. A carton including:

a substantially planar bottom panel;

first side walls hinged to the edge of said bottom panel and extending upwardly therefrom;

a top panel hingedly secured along one edge to one of said side walls and extending substantially parallel to said bottom panel, said top panel being substantially identical in size and shape to said bottom panel;

second said walls hingedly secured to the remaining edges of said top panel and extending downwardly therefrom and secured to said first side walls;

said bottom panel being cut to define a plurality of tabs adapted to be displaced both upwardly and downwardly from the plane of the bottom panel, thereby being adapted to provide vent openings in the bottom panels and to space an enclosed food product from the bottom panel as well as space the bottom panel from a support surface.

6. A carton according to claim 5 wherein each of the tabs is formed by two semicircular cut lines, the radii of which are unequal, made on opposite sides of a common fold line.

7. A carton according to claim 6 which further includes a strip of film secured to the under surface of the bottom panel, the film being releasably secured such that when it is pulled for removal, the tabs are displaced from the plane of the bottom panel and the bent openings are opened.

8. A carton including:

a substantially planar bottom panel;

first side walls hinged to the edges of said bottom panel and extending upwardly therefrom;

a top panel hingedly secured along one edge to one of said side walls and extending substantially parallel to said bottom panel, said top panel being substantially identical in size and shape to said bottom panel;

second side walls hingedly secured to the remaining edges of said top panel and extending downwardly therefrom and secured to said first side walls;

said bottom panel being cut to define a plurality of tabs each of which has a fold line intermediate one free end and one end hinged to the bottom panel, said bottom panel also being cut to form a slot in the bottom panel parallel to the fold line in the tab, said slot being adapted to receive said free end of said tab, whereby the free end can be locked in place by inserting it into the slot.

9. A carton according to claim 8 which further includes a strip of film secured to the under surface of the bottom panel, the film being releasably secured such that as it is pulled for removal, the tabs are displaced from the plane of the bottom panel and the vent openings are opened.

10. A blank for making a panel including:

a substantially planar bottom panel;

first side wall panels hinged to the edges of said bottom panel;

a top panel hingedly secured along one edge to one of said side walls;

said top panel substantially identical in size and shape to said bottom panel for spaced substantially parallel relation therewith;

second side walls hingedly secured to the remaining edges of said top panel for extending downwardly therefrom and for being secured to said first side walls;

said bottom panel being cut to define a plurality of integral tabs for displacement from the plane of the bottom panel simultaneously to provide vent openings in the bottom panel and to provide means for supporting the carton in one operation without the necessity of a further manipulation of said plurality of integral tabs.

* * * * *